US005612614A

United States Patent [19]

Barrett, Jr. et al.

[11] Patent Number: 5,612,614

[45] Date of Patent: Mar. 18, 1997

[54] CURRENT MIRROR AND SELF-STARTING REFERENCE CURRENT GENERATOR

[75] Inventors: Raymond L. Barrett, Jr., Ft. Lauderdale; Barry Herold, Boca Raton; Grazyna A. Pajunen, Delray Beach, all of Fla.

[73] Assignee: Motorola Inc., Schaumburg, Ill.

[21] Appl. No.: 539,388

[22] Filed: Oct. 5, 1995

[51] Int. Cl.[6] ..... G05F 3/16

[52] U.S. Cl. ..... 323/316; 323/314

[58] Field of Search ..... 323/312, 313, 323/314, 315, 316

[56] References Cited

U.S. PATENT DOCUMENTS 5,545,972 8/1996 Kiehl ..... 323/315
5,559,425 9/1996 Allman ..... 323/315
5,563,502 8/1996 Akioka et al. ..... 323/313
5,581,174 12/1996 Fronen ..... 323/316

*Primary Examiner*—Peter S. Wong
*Assistant Examiner*—Y. J. Han
*Attorney, Agent, or Firm*—John H. Moore

[57] ABSTRACT

A current mirror (100) has an input stage (104) and an output stage (106), both preferably employing FET's. (Field Effect Transistors) An amplifier (102) equalizes drain-to-source voltages between FET's in the input and output stages to provide a higher output impedance. A resistance (R1), coupled in series with an FET in the output stage (106), provides degenerative feedback. A reference current generator (400) is constructed of two such current mirrors, one being the compliment of the other, to provide one or more stable reference currents. Loop gain of the reference current generator (400) is greater than one at start-up, but degenerative feedback reduces the loop gain to one at a predetermined stable operating point.

26 Claims, 4 Drawing Sheets

CURRENT MIRROR AND SELF-STARTING REFERENCE CURRENT GENERATOR

FIELD OF THE INVENTION

This invention relates in general to integrated circuits and more specifically to low power current sources.

BACKGROUND OF THE INVENTION

In a battery powered electronics device, such as a paging receiver, battery life, battery size and weight are among some of the most important considerations. Battery life, for a given size battery, is directly related to current drain and the minimum usable battery voltage from which the equipment will operate. The minimum usable battery voltage is referred to as end cell voltage.

The goal for a very small battery powered device has been to achieve single cell operation with long battery life. In keeping with this goal, it is desirable to design circuits that minimize current drain and that can operate to a very low voltage. Typically, an end cell operating voltage of 1.0 volts is specified.

In addition to the requirements mentioned above, the circuit must operate in a stable manner over the broad range of temperatures that the device will be exposed to when carried on a person or left in an automobile.

Analog integrated circuits are prime examples of circuits which benefit from the requirements discussed above. They require stable reference current sources and current mirrors for the biasing of various internal circuits and as references for analog to digital and digital to analog converters. Current sources and current mirrors designed using the present art have many characteristics that are inconsistent with the foregoing requirements. They have a high operating voltage that restricts the dynamic range of the signal that they can handle; they consume more current than is desirable; they use large geometry components; they have an undesirably low output impedance that affects the device accuracy; and they require complex ancillary circuits, such as startup circuits, to insure their proper operation.

Accordingly, what is needed is an improved current mirror and reference current source that are stable with temperature and supply voltage variations, consume little current, have a high output impedance and do not require additional supporting circuits for proper operation.

DESCRIPTION OF THE PREFERRED EMBODIMENT

Figure 1:
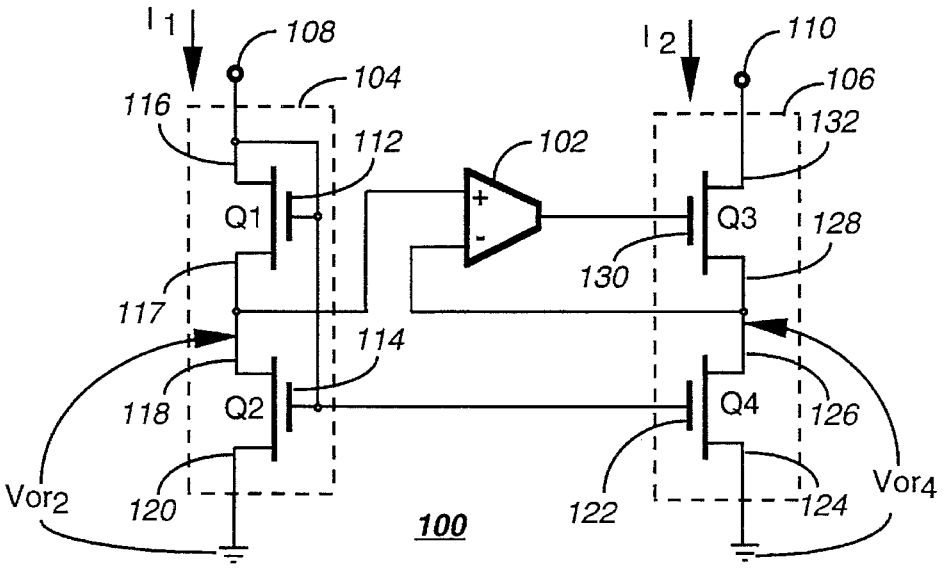
FIG. 1 is an electrical schematic diagram of a precision current mirror in accordance with the present invention.

A precision current mirror 100, shown in FIG. 1, is constructed in accordance with the invention to exhibit a very high output impedance while operating from a supply voltage as small as 1.0 volts. The current mirror 100 has an input stage 104 conducting an input current I1 that flows into an input node 108. The precision current mirror 100 also has an output current I2 that mirrors the input current I1 and that flows into an output node 110. I2 is said to "mirror" I1 when I2 is essentially equal to I1 or when I2 has a selected ratio to I1.

The input stage 104 and the output stage 106 each have at least one transistor conducting the input current I1 and the output current I2, respectfully. Preferably, the input stage 104 includes a pair of cascode-connected MOS (Metal Oxide Semiconductor) FET's (Field Effect Transistors) Q1 and Q2 that are preferably interconnected and fabricated as a single composite transistor. Composite transistors are known to provide superior output impedance combined with a higher cutoff frequency than a single device constructed to obtain either an equal output impedance or cutoff frequency.

The composite transistor comprises first and second transistors fabricated with a common channel and two gates. The ratio of the width to the length of the gate of the first transistor is constructed to be substantially greater then the ratio of the width to length of the gate of the second transistor. This construction results in the transconductance of the first transistor being greater than the transconductance of the second transistor. The design of such composite transistors is described in "Microelectronic Circuits", third edition, by Adel S. Sedra and Kenneth C. Smith, Harcourt Brace College Publishers, Fort Worth, Tex.

Referring to the input stage 104,the composite transistor therein is diode connected. That is, the gate 112 of Q1 and the gate 114 of Q2 are connected to the drain 116 of Q1, forming a two terminal device having a diode-like current to voltage characteristic.

As mentioned above, the fabrication of a composite transistor results in transistor Q1 having a higher transconductance than the other transistor Q2. For the reasons discussed immediately below, this is a desirable result.

The same current I1 flows through the series connection of Q1 and Q2, but the gate 112 to source 117 voltage of Q1 is less than the gate 114 to source 120 voltage of Q2. Transistor Q2 has the full voltage at Q1's drain 116 applied to Q2's gate 114, while Q1's gate 112 to source 117 voltage is reduced by the drain 118 to source 120 voltage of Q2. Because Q1 must conduct the same drain 116 to source 117 current as Q2, but with a lower gate 112 to source 117 voltage than the gate 114 to source 120 of Q2, it must have a higher transconductance.

The output stage 106 also preferably includes a pair of MOS FET's Q3, Q4 that are interconnected in a cascode arrangement. Further, the fabrication of transistors Q3 and Q4 is substantially identical to the fabrication of transistors Q1 and Q2 to ensure that cascode connected transistors Q3 and Q4 have matching characteristics to cascode connected transistors Q1 and Q2. However, transistors Q3 and Q4 do not form a "composite" transistor, because their gates are not interconnected.

The source 120 of Q2 and the source 124 of Q4 are connected to a reference potential, in this example ground. The gate 122 to source 124 voltage of Q4 is equal to the gate 114 to source 120 voltage of Q2 and therefore, by virtue of identical construction, I2 will be nearly the same as I1.

In a conventional current mirror, variation in the drain 126 to source 124 voltage of Q4 compared to the drain 118 to source 120 voltage of Q2 will cause the output current I2 to deviate from the current I1. In the present invention, an operational transconductance amplifier (OTA) 102 senses, at its negative input terminal, the voltage ($Vor_4$) between the output electrode (drain 126) of Q4 and the reference potential (ground in this case); and at its positive input terminal the OTA 102 senses the voltage ($Vor_2$) between the output electrode (drain 118) of transistor Q2 and the reference potential (ground). Because the sources of Q2 and Q4 are directly connected to ground in this case, the OTA 102 essentially senses the drain-to-source voltages of transistors Q2 and Q4.

In response to any difference between the sensed voltages, the OTA 102 generates an output signal that is applied to the gate 130 of Q3. This changes the gate 130 to source 128 voltage of Q3 and, consequently, the drain 126 to source 124 voltage of Q4, making it nearly equal to the drain 118 to source 120 voltage of Q2. Maintaining the drain 126 to source 124 voltage of Q4 equal to the drain 118 to source 120 voltage of Q2 assures that I2 will be substantially equal to I1, and I2 will be substantially independent of the load impedance connected to the current mirror output node 110. A device or circuit that has a current output that is independent of the load connected is said to have a high output impedance. It will be appreciated by one skilled in the art that the OTA 102 can be replaced by a very high gain voltage amplifier as well.

Maintaining the drain 126 to source 124 voltage of Q4 equal to the drain 118 to source 120 voltage of Q2, by the operation of the OTA 102, results in reliable operation of the precision current mirror 100 down to very low currents, well into the weak inversion or sub-threshold region of the transistors, typically 10 na., depending on device sizes, device threholds, and other variables associated with the fabrication process. Also, because the diode connected arrangement of the transistors Q1 and Q2 in the input stage 104 causes the drain 118 to source 120 voltage of Q2 to be very low, typically 50 millivolts (depending on the same factors mentioned above), the drain 126 to source 124 voltage of the Q4 will also be very low. The operation of Q4 at a very low output voltage provides for a large dynamic range with a low battery voltage. A large dynamic range with low current and low battery voltage is highly beneficial for extending the battery life and performance of portable equipment.

The current gain of the current mirror 100 can be controlled by adding additional pairs of transistors in parallel with the pair of transistors Q1 and Q2, and in parallel with the pair of transistors Q3 and Q4. The transistors connected in parallel preferably have identical construction and characteristics. The current gain of the current mirror 100 is equal to the ratio of the number of cascoded pairs of transistors connected in parallel with Q3 and Q4 to the number of cascoded pairs of transistors connected in parallel with Q1 and Q2. For example, if it were desirable to have a current gain of 10/9 , eight additional composite transistors would be connected in parallel with the composite transistor formed by Q1 and Q2, and nine additional cascode pairs of transistors would be connected in parallel with transistors Q3 and Q4.

Figure 2:
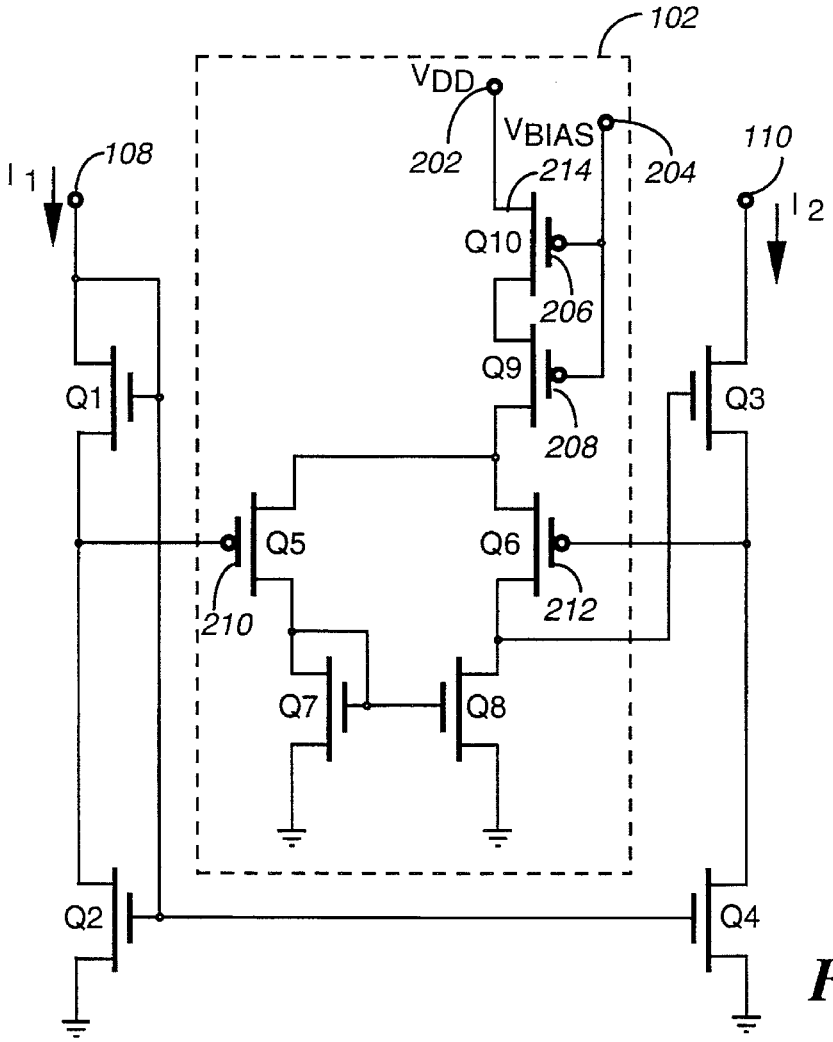
FIG. 2 is an electrical schematic diagram of the precision current mirror shown in FIG. 1, showing details of the operational transconductance amplifier in accordance with the present invention.

FIG. 2 is an electrical schematic diagram of the precision current mirror of FIG. 1 showing the details of the OTA 102. Transistors Q9 and Q10 form a composite transistor connected as a non-precise current source. A supply voltage $V_{DD}$ is coupled via node 202 to the source 214 of transistor Q10, and the gate 208 of Q9 and gate 206 of Q10 are biased from bias supply $V_{bias}$ at node 204. Bias supply $V_{bias}$ can be derived from any convenient bias source of the correct voltage. For example, in FIG. 4 described below, the bias is derived from the voltage that appears on the current input terminal of the complementary current mirror.

Transistors Q7 and Q8 are connected as a non-precise current mirror that acts as the load for transistors Q5 and Q6. The gate 210 of Q5, the positive input of the OTA 102, is coupled to the drain of transistor Q2, thereby sensing the drain-to-source voltage of that transistor. The gate 212 of transistor Q6, the negative input of the OTA 102, is coupled to the drain of transistor Q4, thereby sensing the drain-to-source voltage of that transistor. Any sensed voltage difference is amplified, presented as an output signal at the drain of transistor Q8, and applied to the gate of transistor Q3 to modify the drain-to-source voltage of transistor Q4.

Figure 3:
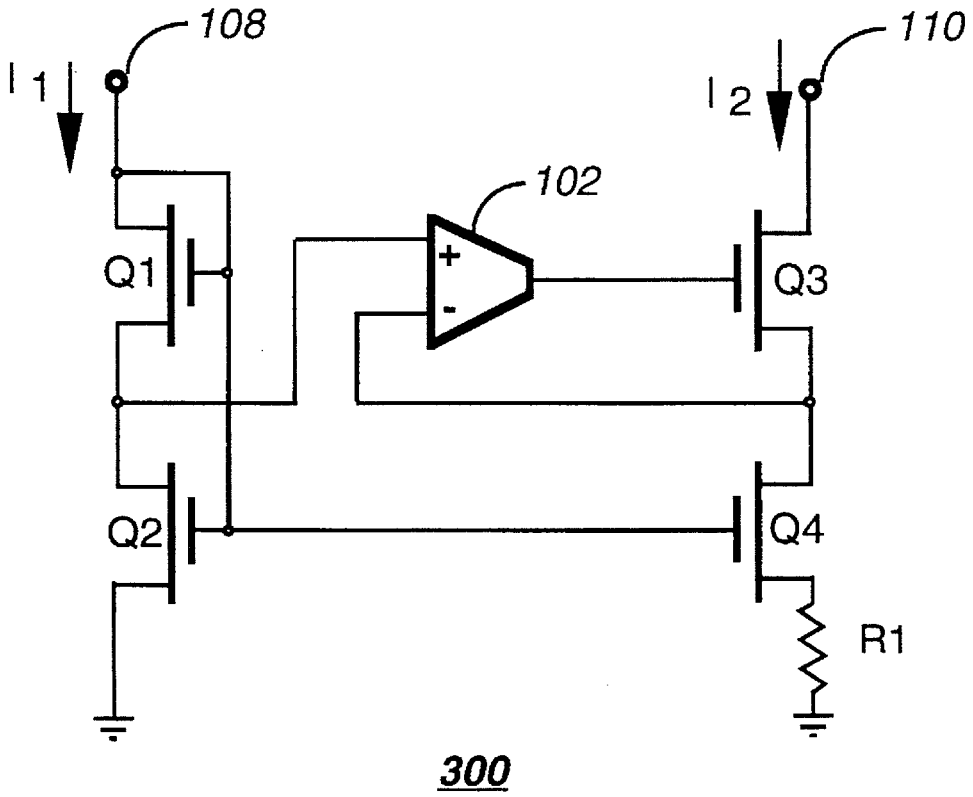
FIG. 3 is an electrical schematic diagram of the precision current mirror of FIG. 1 that has been modified to form a Widlar-like current mirror.

FIG. 3 shows the precision current mirror of FIG. 1 that has been modified by adding a resistance R1 in series with the transistor Q4 to form a Widlar-like current mirror in accordance with another aspect of the present invention. A Widlar-current mirror is a non-precise current mirror, one whose current gain is a function of its input current. The addition of resistance R1 introduces a degenerative feedback that causes a Widlar-current mirror to have a current gain characteristic that varies inversely with input current. That is, as the current I1 increase from zero current, the current mirror 300 functions similarly to the precision current mirror 100 until the current I2 through resistance R1 causes a voltage across R1 that is significant compared to the voltage from the gate-to-source of Q2. The voltage across the resistance R1 reduces the gate-to-source voltage of Q4, limiting the current I2, and effectively causing the current gain of the current mirror 300 to decrease as the input current I1 increases.

The OTA 102 provides the same improvement to the current mirror 300 as the OTA 102 does to the precision current mirror 100, assuring that the output current I2 will be substantially independent of the load impedance connected to the output node 110. In other words, the current mirror 300 will have a very high output impedance.

Figure 4:
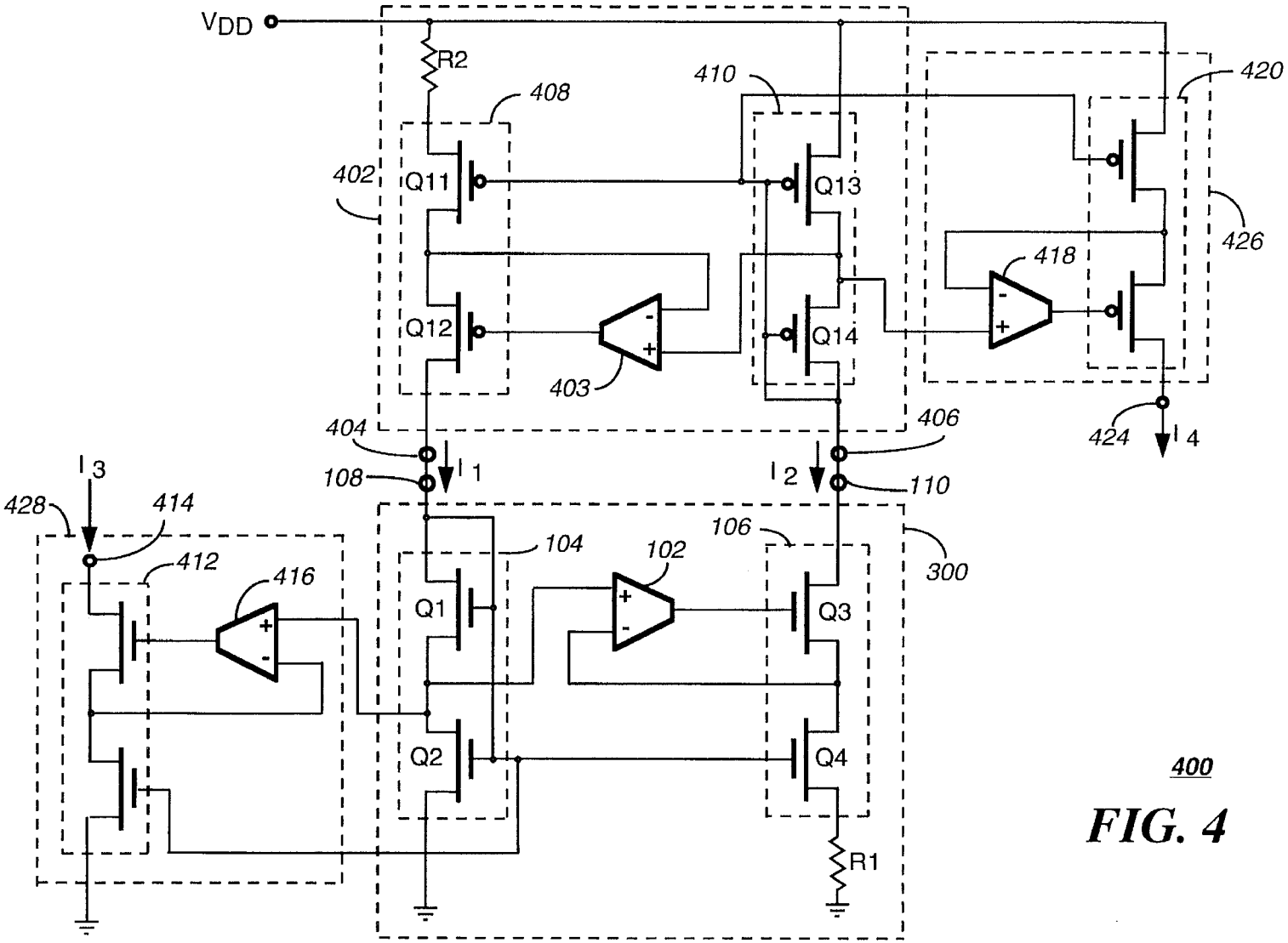
FIG. 4 is an electrical schematic diagram of the reference current generator incorporating the current mirror of FIG. 3 according to another aspect of the present invention.

FIG. 4 shows a first current mirror 300 (the Widlar-like current mirror 300 of FIG. 3) interconnected with a second current mirror 402 which is a complementary Widlar-like current mirror. The current mirrors 300 and 402 together form a precision reference current generator 400 in accordance with the present invention. The reference current generator 400 well be shown below to be a self-starting circuit that gives the designer several areas of freedom to control the operating point and the temperature compensation.

In the current mirror 300, the input stage 104 and the output stage 106 use NMOS FET's and have ground as a reference potential. The current mirror 402 is constructed to be a complement of the current mirror 300; the input stage 410 and the output stage 408 use PMOS FET's connected to a $V_{DD}$ supply which provides a positive reference potential.

With the illustrated connection of two complementary current mirrors, the transistors Q1 and Q2 form a first input stage 104 that conducts an input current I1 from the input node 108. The transistors Q3 and Q4 form a first output stage that conducts, from node 110, an output current I2 that mirrors the current I1. The node 110 is coupled to a node 406 of the second current mirror 402.

A second input stage 410 of the current generator 400 includes transistors Q13 and Q14, interconnected and fabricated to form a composite transistor, and receiving the current I2 from the first output stage 106.

A second output stage 408, formed by cascode connected transistors Q11 and Q12, is coupled to the second input stage 410 and mirrors the current I2. That mirrored current is supplied as input current I1 to the first input stage 104.

The current generator 400 also includes impedance means, shown in the form of resistances R1 and R2, coupled to the first and second current mirrors 300, 402 so as to provide degenerative feedback. The resistance R1, coupled to the source of transistor Q4, provides degenerative feedback for the first current mirror 300. The resistance R2, coupled to the source of transistor Q11, provides degenerative feedback for the second current mirror 402. This degenerative feedback reduces the current gain of the first and second current mirrors as the input current I1 and the output current I2 increase. This causes the collective gain of the first and second current mirrors to be reduced to one when the input current I1 (and/or current I2) reaches a predetermined stable value.

As discussed previously, the amplifier 102 senses the drain-to-reference potential voltage (Vdr) of Q2 and Q4, and applies an output signal to Q3 to cause the sensed differences to be minimized, thereby raising the output impedance of the first current mirror 300.

Likewise, the second current mirror 402 includes an amplifier 403 having a positive input coupled to the drain of transistor Q13, and a negative input coupled to the drain of transistor Q11. With this arrangement, the amplifier 403 senses the drain-to-reference potential voltage (Vdr) of transistors Q11 and Q13, and generates an output signal indicative of any sensed difference. That output signal is applied to the gate of transistor Q12, altering the drain-to-reference potential voltage of the transistor Q11 so as to match the drain-to-reference potential voltage of the transistor Q13. Consequently, the output impedance of the second current mirror 402 is raised.

Preferably, the gain of the current mirror 300 and the gain of the current mirror 402 are both set to be greater than one when the currents I1 and I2 are less than a predetermined, quiescent operating point. As described above, the gain is set by the number of input and output transistors that are connected in parallel. In this example, the gain of each current mirror is set to 10/9 using the following technique.

The composite transistor formed by Q1 and Q2 in the input stage 104, and the composite transistor formed by Q13 and Q14 in the input stage 410, are each, in actual practice, nine composite transistors connected in parallel. The cascode connected transistors Q3 and Q4 in the output stage 106, and the cascode connected transistors Q11 and Q12 in the output stage 408 are, in actual practice, ten pairs of cascode connected transistors in parallel. Thus, the ratio of output transistor pairs to input transistor pairs is 10 to 9, giving a gain of 10/9 for each current mirror. However it will be appreciated that other ratios greater then one can be used as well.

Figure 5:
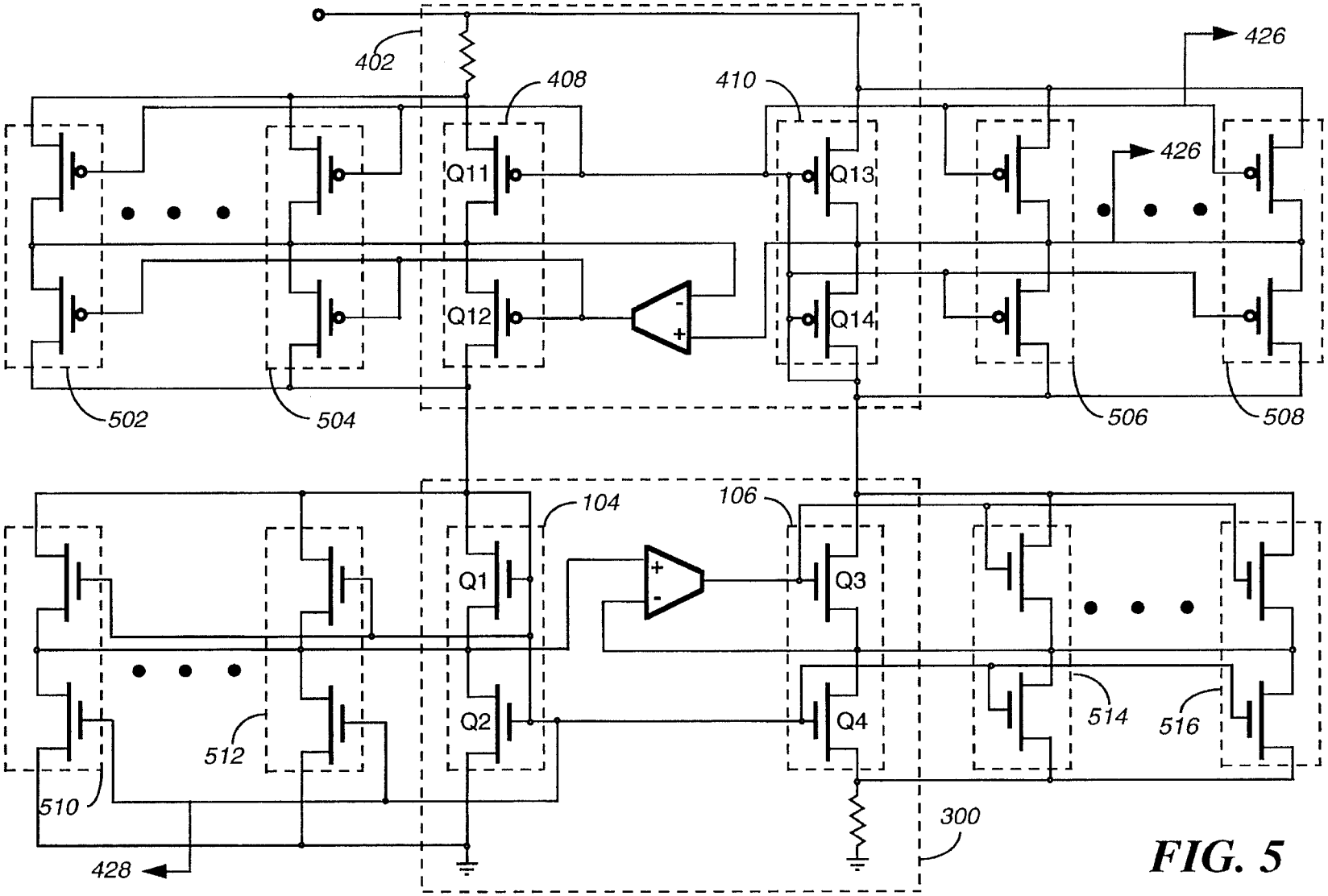
FIG. 5 is a portion of the schematic diagram shown in FIG. 4 illustrating how parallel transistors may be incorporated in the input and output stages of the current mirrors used in the reference current generator.

FIG. 5 shows the details of the connections of the parallel transistors described above. The cascode connected transistors Q11 and Q12 in the output stage 408 of the current mirror 402, are connected in parallel with a plurality of cascode connected transistor pairs, shown as cascode connected transistor pair 502 and cascode connected transistor pair 504. To achieve a gain of 10/9, a total of 10 transistor pairs would be connected in parallel.

The composite transistor formed by Q13 and Q14 in the input stage 410 is connected in parallel with a plurality of composite transistors, shown as composite transistor 506 and composite transistor 508. Nine such composite transistors connected in parallel would provide the current mirror 402 with a gain of 10/9.

The composite transistor formed by Q1 and Q2 in the input stage 104 is connected in parallel with a plurality of composite transistors, shown as composite transistor 510 and composite transistor 512. Nine such composite transistors are connected in parallel in this example.

The pair of cascode connected transistors Q3 and Q4 in the output stage 106 is connected in parallel with a plurality of pairs of cascode connected transistors, shown as cascode connected transistors 514 and 516. Ten such pairs of cascode connected transistors are connected in parallel, thus also providing the current mirror 300 with a gain of 10/9.

The arrangement of paralleled transistors, as described above, sets the gain of the current mirrors 300 and 402 to a value greater than one (e.g. 10/9) when the current in each current mirror is less than the quiescent predetermined stable operating point. This positive gain causes the currents I1 and I2, at start-up, to increase until the limiting, caused by the degeneration introduced by R1 and R2, reduces the loop gain to one. Further increases in the currents I1 and I2 will cause the loop gain to drop below one, causing the currents I1 and I2 to decrease. Thus, the currents will tend to stabilize at a predetermined stable value, where the loop gain is equal to one.

A second beneficial effect of having more parallel transistors in the output stages than in the input stages is that the output stages will have more leakage current than the input stages, assuring that there will always be a surplus of leakage current to initiate start-up.

In addition to the reference current generator 400 requiring a stable, predetermined operating value with variations of supply voltage and load impedance, it must also be stable with temperature variations. PMOS transistors have a substantially different temperature coefficient than NMOS transistors. This difference in temperature coefficient causes the current mirror 402 to have a different temperature coefficient then the current mirror 300. An understanding of the temperature coefficients of the reference current generator 400 can be gained by the following first order analysis.

When operating in the weak inversion region, an MOS transistor behaves in a exponential manner and the Widlar current mirror bipolar transistor transfer function can be used. The transfer function for the current mirror 300 is as follows:

$$I2 \cdot R1 = K1 \cdot \ln (I1/I2).$$

The transfer function for the complementary current mirror 402 is as follows:

$$-I1 \cdot R2 = K2 \cdot \ln (I2/I1)$$

Where:

K1=a variable that comprises the electron mobility, temperature coefficients, length to width ratio, and $V_t$ of the transistors Q1 and Q2 in the input stage 104, and of the cascode connected transistors Q3 and Q4 in the output state 106 in the current mirror 300; and K2=a variable that comprises the electron mobility, temperature coefficient, length to width ratio, and $V_t$ of the cascode connected transistor Q11 and Q12 in the output stage 408, and of the transistors Q13 and Q14 in the input stage 410 in the current mirror 402.

The ratio of the two transfer functions yields:

$$(I2/I1)\cdot(R1/R2)=K1/K2$$

The above equation has the advantage that all of the terms are expressed as ratios which are more controllable in the fabrication of an integrated circuit than absolute values. It will be appreciated that, not only the ratio of R1 to R2, but also the ratio of the temperature coefficient of R1 to the temperature coefficient of R2, can be adjusted to compensate for the temperature coefficients of the NMOS and PMOS transistors. The flexibility given to the designer by controlling the ratio of the magnitude of R1 and R2, and the ratio of the temperature coefficients of R1 and R2, allows one to compensate for the effects of other parameters. Other parameters, such as the electron mobility and the temperature coefficients of the semiconductor material, have a major impact on the operation of the circuit, but may not be readily altered by the designer.

The operating point of the reference current generator 400 can be controlled by selection of the number of parallel transistors in the current mirror's input and output stages. This configuration of paralleled transistors results in a design that can be scaled to produce any desired current. For example, with ten parallel pairs of transistors in the output stage 106, and another ten pairs in the output stage 408, and with 10 nA of current flowing in each pair of transistors, I1 and I2 together equal 100 nA.

It will be appreciated that although the first order analysis described above deals with operation of the reference current generator 400 in the sub-threshold region (sometimes called the weak inversion region), the current generator 400 can be operated in the strong inversion region as well.

One skilled in the art, having determined the characteristics of the transistors produced by the fabrication process being used, can through a series of simulations, empirically adjust the ratio of R1 and R2 and the ratio of the temperature coefficients of R1 and R2, to produce currents I1 and I2 that have a temperature coefficient that approaches zero.

The reference current generator 400 can be equipped with one or more outputs to meet the requirements of the intended application. For this purpose, the reference current generator includes circuitry that is responsive to at least one of the input current I1 and the output current I2 for establishing at least one reference current for external use. In the illustrated embodiment, two reference currents are established in the following manner.

The reference current generator 400 has two output nodes, a current sink node 414 and a current source node 424. The magnitude of current I3 flowing into the current sink node 414 is controlled by the current mirror formed by the input stage 104 and the current sink output circuit 428, and is responsive to current I1. The current sink output circuit 428 comprises cascode connected transistors Q15 and Q16 in output stage 412, and an OTA 416. The operation and construction of this precision mirror is the same as the operation and construction of the precision current mirror 100 (FIG. 1). Suffice it to say that the output stage 412 sinks a current I3 into the node 414 that is a mirror of the current I1, and the output circuit 428 has a high output impedance.

The magnitude of the current I4 flowing out of current source node 424 is controlled by the current mirror formed by the input stage 410 and the current sink output circuit 426, and is responsive to I2. The current sink output circuit 426 comprises cascode connected transistors Q17 and Q18 in output stage 420 and an OTA 418. The operation of the output circuit 426 is similar to the operation of the output circuit 428 in that the output circuit 426 sinks a current I4 that mirrors the current I2 and the circuit 426 also exhibits a high output impedance.

The currents I3 and I4 provide stable and accurate current reference that are required for accurate analog-to-digital and digital-to-analog converters. The stability of I3 and I4 makes them ideal for biasing sensitive analog circuits.

The present invention provides a low power, stable current source and current mirror of simple construction that has a low operating voltage, large dynamic range and low current drain. The stability and low power consumption of the precision current mirror 100 and the precision current reference 400 will enhance the performance of battery powered equipment.

Although the invention has been described in terms of preferred circuitry, it will be obvious to those skilled in the art that many alterations and modifications may be made without departing from the invention. For example, the output circuits 426 and 428 need not be constructed as part of precision current mirrors. In some applications, non-precision current mirrors will suffice. Further, various circuits have been shown as being constructed with MOS transistors, but bipolar transistors may be used for certain applications. Accordingly, it is intended that all such modification and alterations be considered as within the spirit and scope of the invention as defined by the appended claims.

What is claimed is:

1. A current mirror, comprising:

an input stage having at least one transistor conducting an input current;

an output stage having at least one transistor conducting an output current that mirrors the input current, each of the transistors having a control electrode and an output electrode, with a third electrode that is coupled to a reference potential, and each transistor having a voltage Vor between its output electrode and the reference potential to which its third electrode is coupled;

an amplifier sensing Vor voltages of both transistors and generating an output signal indicative of a sensed difference; and transistor means coupled between the amplifier and the output electrode of the transistor in the output stage and responsive to the output signal for altering the Vor voltage of the transistor in the output stage.

2. A current mirror as set forth in claim 1 including a resistance coupled in series with the transistor in the output stage to provide degenerative feedback.

3. A current mirror as set forth in claim 1 wherein the amplifier is an operational transconductance amplifier.

4. A current mirror as set forth in claim 1 wherein each transistor is a FET (Field Effect Transistor).

5. A current mirror as set forth in claim 4 wherein the amplifier's output signal causes the Vor voltages of both FET's to be substantially the same.

6. A current mirror, comprising:

an input stage having at least one FET (Field Effect Transistor) conducting an input current;

an output stage having at least one FET conducting an output current that mirrors the input current, each FET having a drain, a source coupled to a reference potential, and a voltage Vdr from drain to reference potential;

an amplifier sensing the Vdr voltages of both FET's and generating an output signal indicative of a sensed difference; and another FET coupled between the amplifier and the drain of the FET in the output stage and responsive to the output signal for altering the Vdr voltage of the FET in the output stage.

7. A current mirror as set forth in claim 6 wherein the input stage includes a first and second FET forming a composite transistor.

8. A current mirror as set forth in claim 7 including a resistance coupled between the reference potential and the source of the second FET in the output stage.

9. A current mirror as set forth in claim 6 wherein the FET in the output stage and said another FET are interconnected in a cascode arrangement.

10. A current mirror, comprising:

an input stage having at least first and second FET's forming a composite transistor and conducting an input current;

an output stage having at least first and second FET's connected in a cascode arrangement and conducting an output current that mirrors the input current, each FET having a drain, a gate, and a source, each of the second FET's in the input and output stages having its source coupled to a reference potential and having a voltage (Vdr) between its drain and the reference potential;

a resistance coupled in series between the reference potential and the source of the second FET in the output stage; and an amplifier sensing the Vdr of each second FET in the input and output stages and generating an output signal indicative of a sensed difference, the output signal being coupled to the gate of the first FET in the output stage.

11. A self-starting reference current generator, comprising:

a first current mirror having a first input stage conducting an input current, and a first output stage coupled to the first input stage, the first output stage conducting an output current that mirrors the input current;

a second current mirror having a second input stage receiving the output current from the first output stage, and a second output stage coupled to the second input stage, the second output stage mirroring the output current received by the second input stage and supplying the mirrored output current as input current to the first input stage, the first and second current mirrors having a collective current gain whose value exceeds one prior to the input current reaching a predetermined stable value;

impedance means coupled to the first and second current mirrors so as to provide degenerative feedback which reduces the current gain of the first and second current mirrors as the input and output currents increase, such that the collective gain of the first and second current mirrors is reduced to one when the input current reaches the predetermined stable value; and circuitry responsive to at least one of the input current and the output current for establishing at least one reference current.

12. A reference current generator as set forth in claim 11 wherein each of the first and second current mirrors has a current gain exceeding one prior to the input current reaching the predetermined stable value.

13. A reference current generator as set forth in claim 11 wherein the first output stage includes a transistor conducting the output current, wherein the second output stage includes another transistor conducting the mirrored output current, and wherein the impedance means includes a resistance coupled in series with the transistor in the first output stage, and another resistance in series with the transistor in the second output stage.

14. A reference current generator as set forth in claim 11 wherein each of the first and second input stages, and each of the first and second output stages, comprise at least first and second FET's (Field Effect Transistors) connected in a cascode arrangement to form a cascode pair of FET's.

15. A reference current generator as set forth in claim 14 wherein each cascode pair of FET's in the first and second input stages is a composite transistor.

16. A reference current generator as set forth in claim 14 wherein each FET has a source, a drain and a gate, and wherein the impedance means comprises a resistance coupled in series with the source of the second FET in each of the first and second output stages.

17. A reference current generator as set forth in claim 14 wherein the first and second FET's in the first and second input stages and first and second output stages operate in a weak inversion mode.

18. A reference current generator as set forth in claim 14 wherein the first and second input stages each includes a number of cascode pairs of FET's, wherein the first and second output stages each include a number of cascode pairs of FET's, and wherein the number of cascode pairs in the output stage of each current mirror exceeds the number of cascode pairs in the input stage of each current mirror.

19. A reference current generator as set forth in claim 14 wherein each FET has a gate, a source and a drain, wherein each second FET in the first and second current mirrors has a source coupled to a reference potential, and a Vdr voltage between its drain and the reference potential to which its source is coupled and further including an amplifier sensing the Vdr voltage of each second FET in the first current mirror and generating an output signal indicative of any sensed difference, the first FET in the output stage of the first current mirror receiving the output signal for altering the Vdr voltage of the second FET in the output stage of the first current mirror.

20. A reference current generator as set forth in claim 19 wherein the impedance means includes a resistance coupled between the reference potential and the source of the second FET's in the first and second output stages.

21. A reference current generator as set forth in claim 19 wherein the amplifier is an operational transconductance amplifier.

22. A reference current generator as set forth in claim 19 wherein the amplifier's output signal causes the Vdr voltage of the second FET to be altered so as to make that voltage substantially equal to the Vdr voltage of the second FET in the input stage of the first current mirror.

23. A reference current generator as set forth in claim 19 including a second amplifier sensing the Vdr voltage of each second FET in the second current mirror and generating a second output signal, the first FET in the output stage of the second current mirror receiving the output signal for altering the Vdr voltage of the second FET in the output stage of the second current mirror such that the latter voltage is made substantially equal to the Vdr voltage of the second FET in the input stage of the second current mirror.

24. A self-starting reference current generator, comprising:

a first input stage having at least first and second FET's (Field Effect Transistors) forming a composite transistor and conducting an input current:

a first output stage coupled to the first input stage and having at least a first and a second FET connected in a cascode arrangement and conducting an output current that mirrors the input current, the first input stage and the first output stage together forming a first current mirror having a current gain whose value exceeds one prior to the input current reaching a predetermined stable value;

a first resistance coupled in series with the second FET in the first output stage so as to provide degenerative feedback;

a second input stage having at least a first and a second FET forming a composite transistor receiving the output current from the first output stage;

a second output stage having at least a first and a second FET connected in a cascode arrangement for mirroring the output current received by the second input stage and supplying the mirrored output current as input current to the first input stage, the second input stage and the second output stage together forming a second current mirror having a current gain whose value exceeds One prior to the input current reaching the predetermined stable value;

a second resistance coupled in series with the second FET in the second output stage so as to provide degenerative feedback, wherein each FET has a gate, a source and a drain, and wherein each second FET in the first and second current mirrors has a source coupled to a reference potential, and a Vdr voltage between its drain and the reference potential to which its source is coupled;

a first amplifier sensing differences between the Vdr voltages of the second FET's in the first input stage and in the first output stage and developing an output signal that is coupled to the second FET in the first output stage to minimize the sensed differences;

a second amplifier sensing differences between the Vdr voltages of the second FET's in the second input stage and in the second output stage, and developing an output signal that is coupled to the second FET in the second output stage to minimize the sensed differences; and circuitry responsive to the input and output currents for establishing first and second reference currents.

25. A reference current generator as set forth in claim 24 wherein the amplifiers are operational transconductance amplifiers.

26. A reference current generator as set forth in claim 24 wherein the first and second FET's in the first and second input stages and first and second output stages operate in a weak inversion mode.

* * * * *